US011215063B2

(12) United States Patent
Sarawate et al.

(10) Patent No.: US 11,215,063 B2
(45) Date of Patent: Jan. 4, 2022

(54) SEAL ASSEMBLY FOR CHUTE GAP LEAKAGE REDUCTION IN A GAS TURBINE

(71) Applicant: General Electric Company, Schenectady, NY (US)

(72) Inventors: Neelesh Nandkumar Sarawate, Niskayuna, NY (US); Christopher Walter Falcone, Schenectady, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 14 days.

(21) Appl. No.: 16/598,003

(22) Filed: Oct. 10, 2019

(65) Prior Publication Data

US 2021/0108528 A1 Apr. 15, 2021

(51) Int. Cl.

| | |
|---|---|
| ***F01D 11/00*** | (2006.01) |
| ***F01D 9/04*** | (2006.01) |
| ***F01D 11/02*** | (2006.01) |

(52) U.S. Cl.

CPC ..... *F01D 11/001* (2013.01); *F01D 9/042* (2013.01); *F01D 11/02* (2013.01); *F05D 2240/55* (2013.01)

(58) Field of Classification Search

CPC ..... F01D 11/00; F01D 11/001; F01D 11/005; F01D 11/006; F01D 11/008; F01D 11/02; F01D 9/04; F01D 9/041; F01D 9/042; F16L 1/00–2201/80; F16J 15/02; F16J 15/022; F05D 2240/55

(Continued)

(56) References Cited

U.S. PATENT DOCUMENTS

| | | | |
|---|---|---|---|
| 5,154,577 | A | 10/1992 | Kellock et al. |
| 5,188,507 | A | 2/1993 | Sweeney |

(Continued)

FOREIGN PATENT DOCUMENTS

| | | | |
|---|---|---|---|
| EP | 2039886 | A1 | 3/2009 |
| EP | 2479384 | A2 | 7/2012 |
| EP | 2832975 | A1 | 2/2015 |

OTHER PUBLICATIONS

Aksit et al., "Parasitic corner leakage reduction in gas turbine nozzle-shroud inter-segment locations", 37th Joint Propulsion Conference and Exhibit, 2001, Salt Lake City, U.S.A.

(Continued)

*Primary Examiner* — Christopher Verdier
*Assistant Examiner* — Elton K Wong
(74) *Attorney, Agent, or Firm* — Armstrong Teasdale LLP

(57) ABSTRACT

Various embodiments include gas turbine seals and methods of forming such seals. In some cases, a turbine includes: a first arcuate component adjacent to a second arcuate component, each arcuate component including a slot including one or more slot segments located in an end face and a seal assembly disposed in the slot. The seal assembly including a plurality of seal segments forming at least one T-junction where a first seal segment intersects a second seal segment and at least one shim seal. The plurality of seal segments define at least one chute gap. The at least one shim seal disposed in a slot proximate the at least one T-junction of the plurality of seal segments. The at least one shim seal positioned on a sidewall of the second seal segment and extending a partial length of the sidewall. The at least one shim seal seals the at least one chute gap to prevent a flow therethrough of a gas turbine hot gas path flow.

22 Claims, 10 Drawing Sheets

(58) Field of Classification Search
USPC ..... 285/1–925
See application file for complete search history.

(56) References Cited

U.S. PATENT DOCUMENTS

| | | | | |
|---|---|---|---|---|
| 5,224,713 | A | 7/1993 | Pope | |
| 5,967,745 | A | 10/1999 | Tomita et al. | |
| 6,343,792 | B1 | 2/2002 | Shinohara et al. | |
| 6,659,472 | B2 | 12/2003 | Aksit et al. | |
| 7,114,339 | B2 | 10/2006 | Alvanos et al. | |
| 8,105,024 | B2 | 1/2012 | Khanin et al. | |
| 8,727,710 | B2 | 5/2014 | Propheter-Hinckley et al. | |
| 9,068,513 | B2 | 6/2015 | Lee | |
| 9,260,979 | B2 | 2/2016 | Lee et al. | |
| 9,810,086 | B2 | 11/2017 | Correia et al. | |
| 10,167,728 | B2 | 1/2019 | Waki et al. | |
| 10,267,171 | B2 | 4/2019 | Dev et al. | |
| 2011/0304104 | A1* | 12/2011 | McMahan ..... | F01D 11/00 277/637 |
| 2012/0269622 | A1* | 10/2012 | Takaoka ..... | F01D 11/005 415/208.1 |
| 2014/0348642 | A1 | 11/2014 | Weber et al. | |
| 2017/0159478 | A1 | 6/2017 | Dev et al. | |

OTHER PUBLICATIONS

Raymond E Chupp, "Advanced Seal Development for Large Industrial Gas Turbines", NASA Technical Reports Server, Aug. 1, 2006, U.S.A.

Extended European Search Report for corresponding EP Application No. 20198838.3-1004, dated Feb. 10, 2021.

* cited by examiner

SEAL ASSEMBLY FOR CHUTE GAP LEAKAGE REDUCTION IN A GAS TURBINE

BACKGROUND

The subject matter disclosed herein relates to turbines. Specifically, the subject matter disclosed herein relates to seals in gas turbines.

The main gas-flow path in a gas turbine commonly includes the operational components of a compressor inlet, a compressor, a turbine and a gas outflow. There are also secondary flows that are used to cool the various heated components of the turbine. Mixing of these flows and gas leakage in general, from or into the gas-flow path, is detrimental to turbine performance.

The operational components of a gas turbine are contained in a casing. The turbine is commonly surrounded annularly by adjacent arcuate components. As used herein, the term "arcuate" may refer to a member, component, part, etc. having a curved or partially curved shape. The adjacent arcuate components include outer shrouds, inner shrouds, nozzle blocks, and diaphragms. The arcuate components may provide a container for the gas-flow path in addition to the casing alone. The arcuate components may secure other components of the turbine and may define spaces within the turbine. Between each adjacent pair of arcuate components is a space or gap that permits the arcuate components to expand as the operation of the gas turbine forces the arcuate components to expand.

Typically, a slot, comprising one or more slot segments, is defined on the end faces of each arcuate component for receiving a seal in cooperation with an adjacent slot of an adjacent arcuate component. The seal is placed in the slot to prevent leakage between the areas of the turbine on either side of the seal. These areas may include the main gas-flow path and secondary cooling flows. In some embodiments, the plurality of slot segments within the end of a particular arcuate component may connect one to another. Furthermore, the plurality of slot segments within the end of a particular arcuate component may form a T-junction, also referred to herein as a t-joint, with respect to orientation to each other, and more particularly, where one slot segment intersects a neighboring slot segment. Typically, a planar seal, comprised of a plurality of seal segments, is received in the slot. More particularly, a seal segment is received in each slot segment. Each of the planar seals has ends, with the seal segments being positioned in each of the neighboring slot segments, configured in an end-to-end T-junction orientation. Each adjacent pair of the seal segments forms seal intersection gaps, also referred to herein as chute gaps, between the two seals at the T-junction. These seal intersection gaps permit leakage between the internal and external areas of the gas turbine component, and more particularly, down the slot segments, commonly referred to as chute leakage. It is desirable to reduce these gaps, thus minimizing leakage flow down these chutes, and improve gas turbine performance.

BRIEF DESCRIPTION

Various embodiments of the disclosure include gas turbine seal assemblies and methods of forming such seals. In accordance with one exemplary embodiment, disclosed is a seal assembly to seal a gas turbine hot gas path flow in a gas turbine. The seal assembly includes a segmented seal and at least one shim seal. The segmented seal includes a plurality of seal segments forming at least one T-junction where a first seal segment intersects a second seal segment, and wherein the plurality of seal segments define at least one chute gap. The at least one shim seal includes a plurality of shim seal segments. The at least one shim seal is disposed in a slot proximate the at least one T-junction of the plurality of seal segments. The at least one shim seal is positioned on a sidewall of the second seal segment and extends a partial length of the sidewall. The slot includes a plurality of slot segments. The at least one shim seal seals the at least one chute gap to prevent a flow therethrough of the gas turbine hot gas path flow.

In accordance with another exemplary embodiment, disclosed is a gas turbine. The gas turbine includes a seal assembly to seal a gas turbine hot gas path flow in a gas turbine. The gas turbine includes a first arcuate component adjacent to a second arcuate component, each arcuate component including a slot located in an end face and a seal assembly disposed in the slot of the first arcuate component and the slot of the second arcuate component. Each slot includes one or more slot segments each having one or more substantially axial surfaces and one or more substantially radial surfaces extending from the one or more substantially axial surfaces. The one or more slot segments define one or more T-junctions between neighboring slots. The seal assembly including a segmented seal and at least one shim seal. The segmented seal includes a plurality of seal segments forming at least one T-junction where a first seal segment intersects a second seal segment, and wherein the plurality of seal segments define at least one chute gap. The at least one shim seal is disposed in at least one of the slot of the first arcuate component and the slot of the second arcuate component proximate the at least one T-junction of the plurality of seal segments. The at least one shim seal is positioned on a sidewall of the second seal segment and extending a partial length of the sidewall. The at least one shim seal seals the at least one chute gap to prevent a flow therethrough of the gas turbine hot gas path flow.

In accordance with yet another exemplary embodiment, disclosed is a method of assembling a seal in a turbine. The method includes forming a seal assembly, the forming including: providing a segmented seal, including a plurality of seal segments forming at least one T-junction where a first seal segment intersects a second seal segment, and wherein the plurality of seal segments define at least one chute gap and providing at least one shim seal including a plurality of shim seal segments. The at least one shim seal is disposed proximate the at least one T-junction of the plurality of seal segments. The at least one shim seal is positioned on a sidewall of the second seal segment and extends a partial length of the sidewall. The method further including applying the seal assembly to the turbine, the turbine having: a first arcuate component adjacent to a second arcuate component, each arcuate component including a slot comprising one or more slot segments located in an end face. The applying including inserting the seal assembly in a slot segment of the one or more slots such that the at least one shim seal seals the at least one chute gap to prevent a flow therethrough of the gas turbine hot gas path flow.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
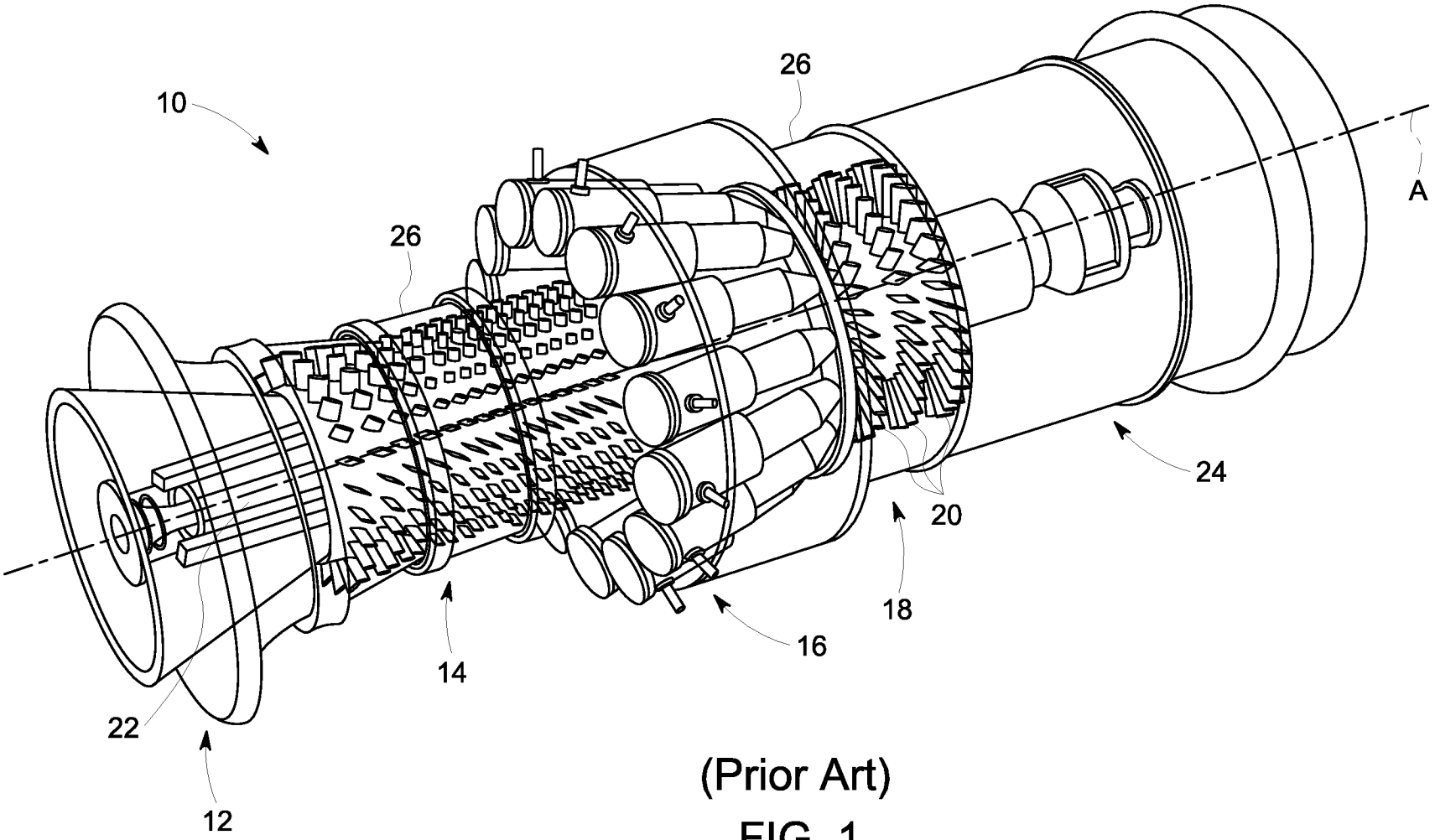
(Prior Art) FIG. 1
FIG. 1 shows a perspective partial cut-away view of a known gas turbine.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

As noted herein, the subject matter disclosed relates to turbines. Specifically, the subject matter disclosed herein relates to cooling fluid flow in gas turbines and the sealing within such turbines. In contrast to conventional approaches, various embodiments of the disclosure include gas turbomachine (or, turbine) static hot gas path components, such as nozzles and shrouds.

As denoted in these Figures, the "A" axis (FIGS. 1, 3, 4, and 12) represents axial orientation (along the axis of the turbine rotor). As used herein, the terms "axial" and/or "axially" refer to the relative position/direction of objects along the axis A, which is substantially parallel with the axis of rotation of the turbomachine (in particular, the rotor section). As further used herein, the terms "radial" and/or "radially" refer to the relative position/direction of objects along an axis (not shown), which is substantially perpendicular with axis A and intersects axis A at only one location. Additionally, the terms "circumferential" and/or "circumferentially" refer to the relative position/direction of objects along a circumference (not shown), which surrounds axis A but does not intersect the axis A at any location. It is further understood that common numbering between the various Figures denotes substantially identical components in the Figures.

Referring to FIG. 1, a perspective view of one embodiment of a gas turbine 10 is shown. In this embodiment, the gas turbine 10 includes a compressor inlet 12, a compressor 14, a plurality of combustors 16, a compressor discharge (not shown), a turbine 18 including a plurality of turbine blades 20, a rotor 22 and a gas outflow 24. The compressor inlet 12 supplies air to the compressor 14. The compressor 14 supplies compressed air to the plurality of combustors 16 where it mixes with fuel. Combustion gases from the plurality of combustors 16 propel the turbine blades 20. The propelled turbine blades 20 rotate the rotor 22. A casing 26 forms an outer enclosure that encloses the compressor inlet 14, the compressor 14, the plurality of combustors 16, the compressor discharge (not shown), the turbine 18, the turbine blades 20, the rotor 22 and the gas outflow 24. The gas turbine 10 is only illustrative; teachings of the disclosure may be applied to a variety of gas turbines.

Figure 2:
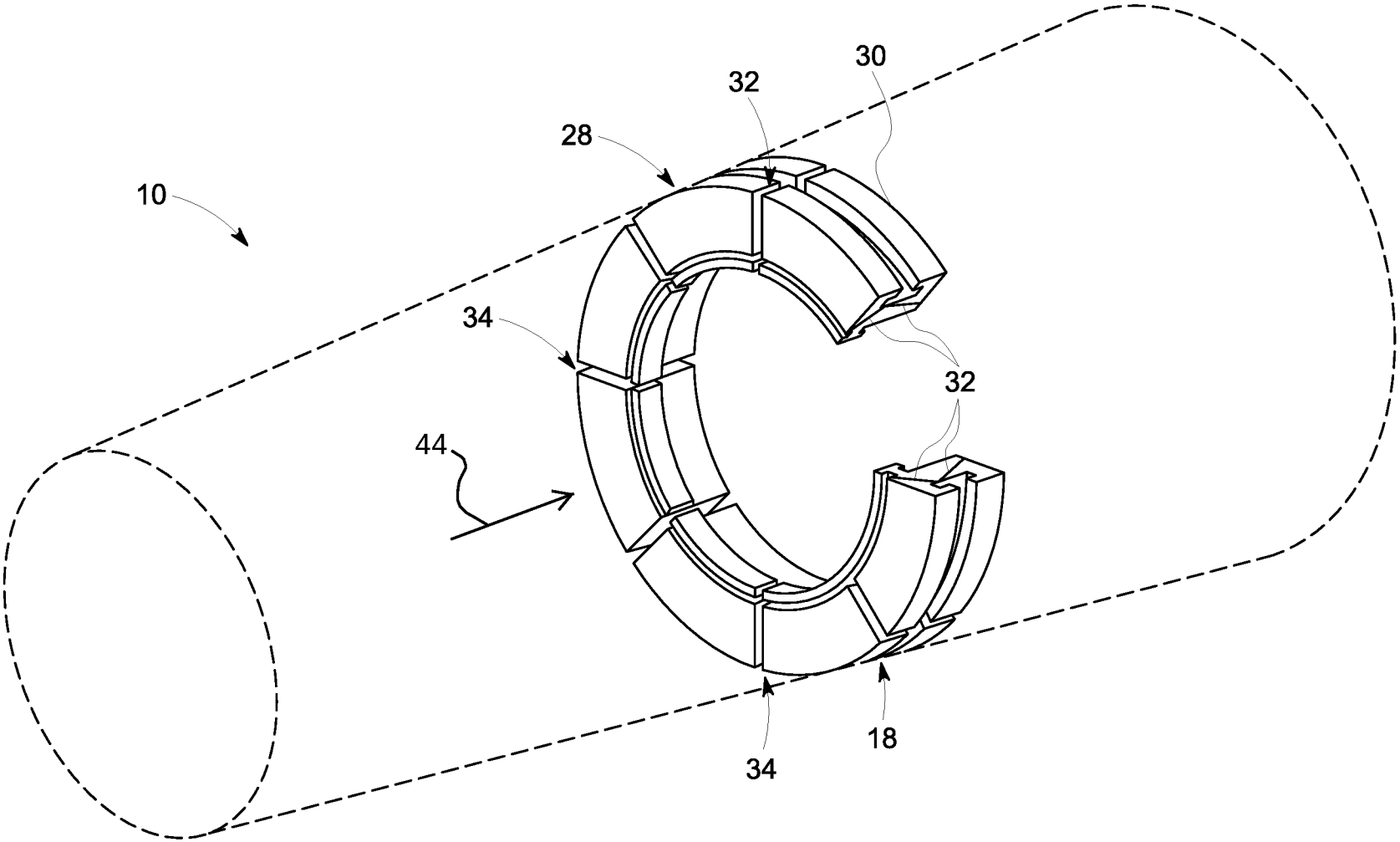
(Prior Art) FIG. 2
FIG. 2 shows a perspective view of known arcuate components in an annular arrangement.

In an embodiment, stationary components of each stage of a hot gas path (HGP) of the gas turbine 10 consists of a set of nozzles (stator airfoils) and a set of shrouds (the static outer boundary of the HGP at the rotor airfoils 20). Each set of nozzles and shrouds are comprised of numerous arcuate components arranged around the circumference of the hot gas path. Referring more specifically to FIG. 2, a perspective view of one embodiment of an annular arrangement 28 including a plurality of arcuate components 30 of the turbine 18 of the gas turbine 10 is shown. In the illustrated embodiment, the annular arrangement 28 as illustrated includes seven arcuate components 30 with one arcuate component removed for illustrative purposes. Between each of the arcuate components 30 is an inter-segment gap 34. This segmented construction is necessary to manage thermal distortion and structural loads and to facilitate manufacturing and assembly of the hardware.

A person skilled in the art will readily recognize that annular arrangement 28 may have any number of arcuate components 30; that the plurality of arcuate components 30 may be of varying shapes and sizes; and that the plurality of arcuate components 30 may serve different functions in gas turbine 10. For example, arcuate components in a turbine may include, but not be limited to, outer shrouds, inner shrouds, nozzle blocks, and diaphragms as discussed below.

Figure 3:
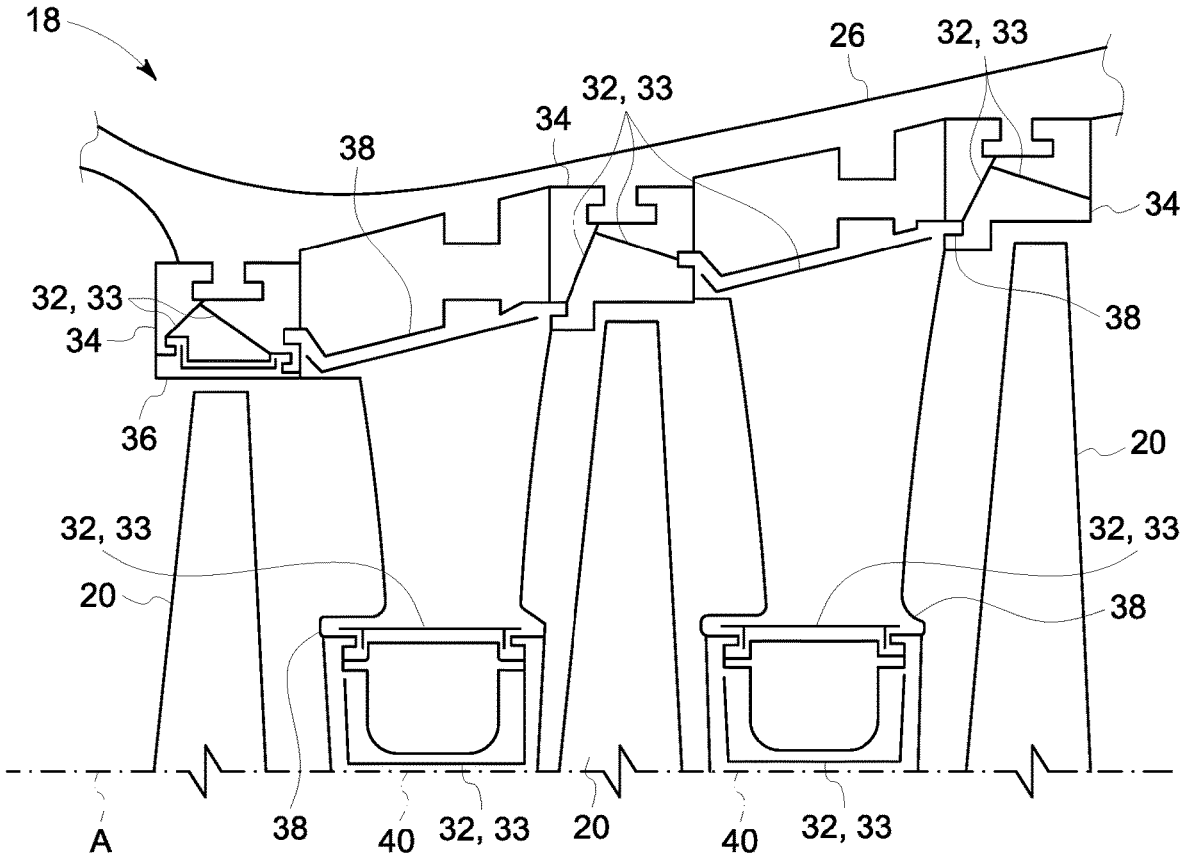
(Prior Art) FIG. 3
FIG. 3 shows a cross-sectional longitudinal view of a known turbine of a gas turbine.

Referring to FIG. 3, a cross-sectional view of one embodiment of turbine 18 of gas turbine 10 (FIG. 1) is shown. In this embodiment, the casing 26 encloses a plurality of outer shrouds 34, an inner shroud 36, a plurality of nozzle blocks 38, a plurality of diaphragms 40, and turbine blades 20. Each of the outer shrouds 34, inner shroud 36, nozzle blocks 38 and diaphragms 40 form a part of the arcuate components 30. Each of the outer shrouds 34, inner shrouds 36, nozzle blocks 38 and diaphragms 40 have a slot 32, comprised of one or more slot segments 33 in a side thereof. In this embodiment, the plurality of outer shrouds 34 connect to the casing 26; the inner shroud 36 connects to the plurality of outer shrouds 34; the plurality of nozzle blocks 38 connect to the plurality of outer shrouds 34; and the plurality of diaphragms 40 connect to the plurality of nozzle blocks 38. A person skilled in the art will readily recognize that many different arrangements and geometries of arcuate components are possible. Alternative embodiments may include different arcuate component geometries, more arcuate components, or less arcuate components.

Cooling air is typically used to actively cool and/or purge the static hot gas path (bled from the compressor of the gas turbine engine 10) leaks through the inter-segment gaps 34 for each set of nozzles and shrouds. This leakage has a negative effect on overall engine performance and efficiency because it is parasitic to the thermodynamic cycle and it has little if any benefit to the cooling design of the hot HGP component. As previously indicated, seals are typically incorporated into the inter-segment gaps 34 of static HGP components to reduce leakage. The slot, and more particularly the one or more slot segments 33 provide for placement of such seals at the end of each arcuate component 30.

These inter-segment seals are typically straight, rectangular solid pieces of various types of construction (e.g. solid, laminate, shaped, such as "dog-bone"). The seals serve to seal a gas turbine hot gas path flow 44 (FIG. 2) in the long straight lengths of the seal slot segments 33 fairly well, but they do not seal intersecting seal slot segments at the intersection of one seal segment with another seal segment where T-junctions are formed. Adjacent seal segments disposed in a T-junction configuration typically result in chute leakage down the seal slot segments 33 in light of manufacturing variation and assembly constraints. It is a significant benefit to engine performance and efficiency to seal these T-junctions more effectively. This is a challenging engine design detail because of numerous design constraints including the tight spaces in the inter-segment gaps 34 and seal slot segments 33, the need for relatively easy assembly and disassembly, thermal movement during engine operation, and the complicated route of leakage at the corner leaks.

Figure 4:
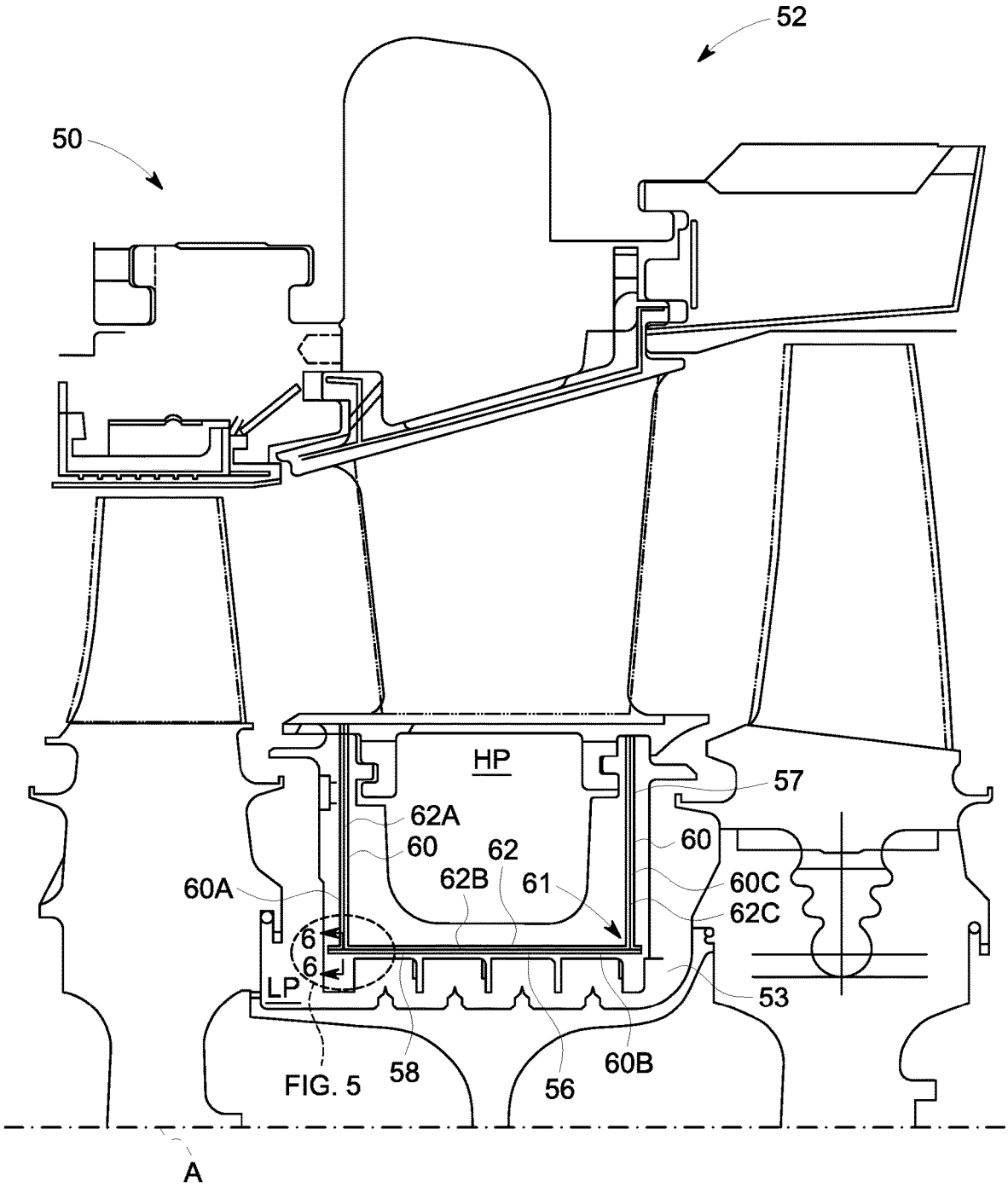
FIG. 4 shows a schematic cross-sectional view of a portion of a turbine, in accordance with one or more embodiments shown or described herein.
Figure 5:
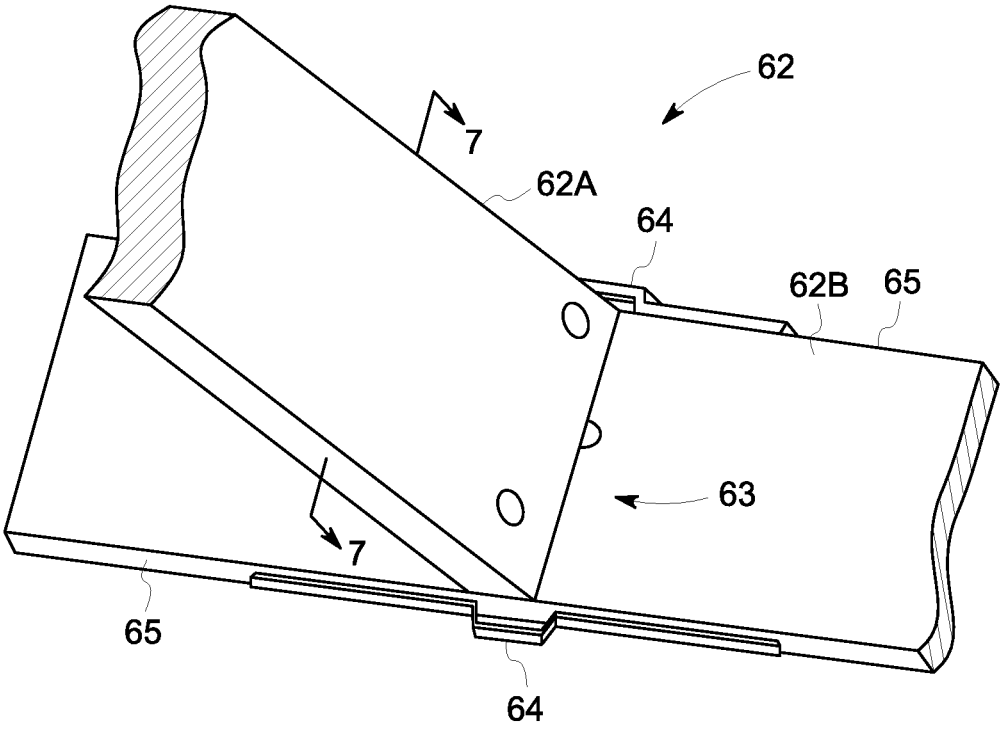
FIG. 5 shows a partial isometric cross-sectional view of the seal assembly of FIG. 4 as indicated by dashed line in FIG. 4, in accordance with one or more embodiments shown or described herein.
Figure 6:
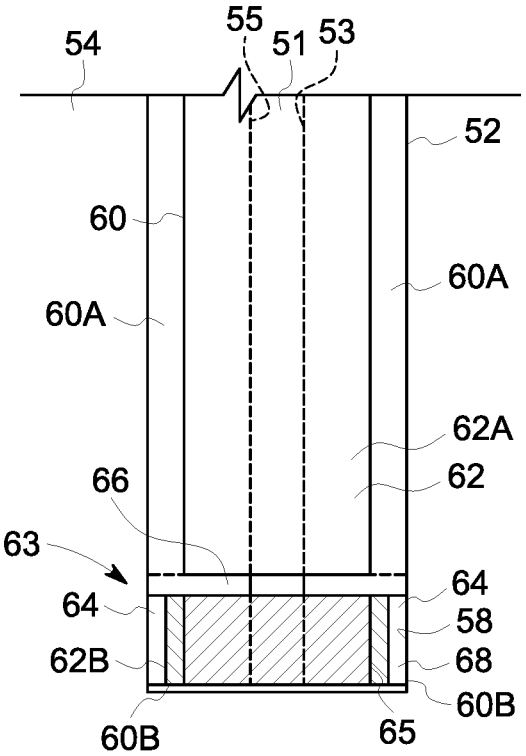
FIG. 6 shows a schematic cross-sectional view of a portion of the seal assembly taken along line 6-6 in FIG. 4, in accordance with one or more embodiments shown or described herein.
Figure 7:
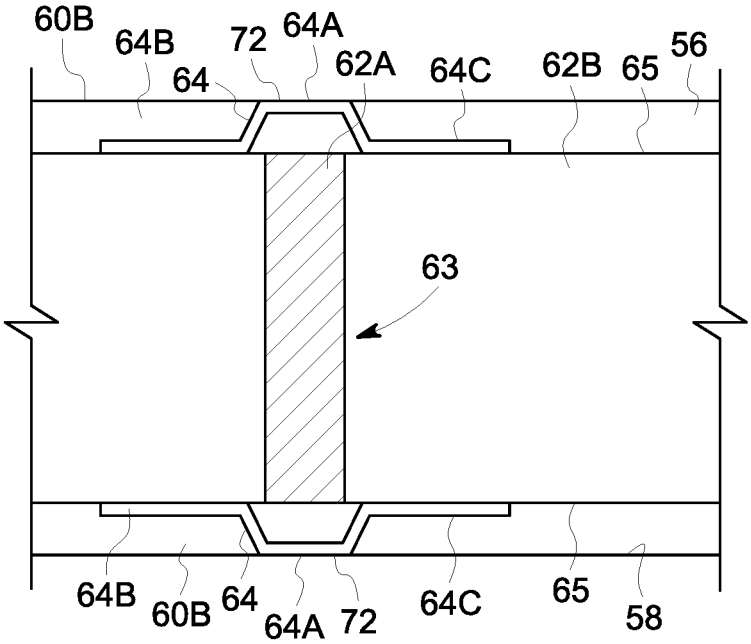
FIG. 7 shows a schematic cross-sectional view of a portion of the seal assembly taken along line 7-7 of FIG. 5, in accordance with one or more embodiments shown or described herein.

Turning to FIGS. 4-7, a cross-sectional longitudinal view of a gas turbine 50, generally similar to gas turbine 10 of FIGS. 1-3, is shown in FIG. 4, according to an embodiment. FIG. 4 shows an end view of an exemplary, and more particularly, a first arcuate component 52. FIG. 5 shows an isometric partial cross-sectional view of a seal assembly as disclosed herein, formed in a generally "T" configuration to define a plurality of T-junctions. FIG. 6 shows an enlargement of a portion of the seal assembly of FIG. 4, taken along line 6-6 in FIG. 4. FIG. 7 shows a schematic cross-sectional view of a portion of the seal assembly of FIG. 5, taken along line 7-7 in FIG. 5, as disclosed herein.

Referring more particularly to FIG. 4, the first arcuate component 52 includes a slot 60 formed in an end face 53 of the first arcuate component 52. The slot 60 may be comprised of multiple slot segments 60A, 60B and 60C shown formed at a substantially right angle in relation to each other and connected to one another. More particularly, slot segments 60A and 60C are configured to form multiple T-junctions 61 (FIG. 4) with slot segment 60B. To define the T-junctions 61, slot segment 60B extends a distance on each side of slot segments 60A and 60C. The slot 60 may be comprised of any number of intersecting or connected slot segments.

A seal assembly 62 is disposed therein slot 60. Similar to the slot segments 60A, 60B and 60C, the seal assembly 62, and more particularly, a segmented seal 57 of the seal assembly 62, may be comprised of multiple seal segments 62A, 62B and 62C shown formed at a substantially right angle in relation to each other and disposed within slot segments 60A, 60B and 60C, respectively. More particularly, seal segments 62A and 62C are configured to intersect seal segment 62B and form multiple T-junctions 63 (FIGS. 5 and 7) with seal segment 62B. In this particular embodiment, seal segment 62B extends a distance on each side of the point of intersection of seal segments 62A and 62C with seal segment 62B to define the T-junctions 63. It is understood that according to various embodiments, the seal segments 62A, 62B and 62C may include any type of planar seal, such as a standard spline seal, solid seal, laminate seal, shaped seal (e.g. dog-bone), or the like. In an embodiment, the seal segments 62A, 62B and 62C may be formed of a plurality of individual layers (e.g. laminate seal) that are only partially coupled to one another, thereby allowing for flexibility of seal segments 62A, 62B and 62C (e.g., torsional movement). The seal assembly 62 may be comprised of any number of intersecting or connected seal segments and that the three segment seal and cooperating slots disclosed herein are merely for illustrative purposes.

Referring now to FIGS. 5-7, FIG. 5 shows a partial cross-sectional axial isometric as noted by dotted circle in FIG. 4. In the illustration of FIG. 5, a portion of the seal assembly 62 is shown, while the slot 60 is not shown. FIG. 6, illustrates a partial sectional view taken through line 6-6 of FIG. 4, and FIG. 7 illustrates a partial sectional view taken through line 7-7 of FIG. 5. As best illustrated in FIG. 6, an intersegmental gap 51, similar to intersegmental gap 34 of FIG. 2, is left between the first arcuate component 52 and the second arcuate component 54, and more particularly their respective end faces 53 and 54. An adjacent slot 60 on the second arcuate component 54 is shown. Similar to slot 60 of the first arcuate component 52, the slot 60 of the second arcuate component 54 may be formed of multiple slot segments, of which slot segments 60A and 60B are shown in FIG. 6, formed at an angle in relation to each other and connected or intersecting to one another at a plurality of T-joints 61 (FIG. 4), as previously described. In this particular configuration, each slot 60 includes a plurality of substantially axial surfaces 56 (FIG. 7) and a plurality of radially facing surfaces 58 or sidewalls (FIG. 7) extending from the end of the substantially axial surfaces 56. Alternate configurations and geometries of the slots 60 are anticipated by this disclosure.

In the illustrated embodiment of FIGS. 4-7, the gas turbine 50 includes the seal assembly 62 disposed in the one or more slots 60, where the seal assembly 62 contacts cooperating slots 60 at their axial surfaces 56 and radially facing surfaces 58. It should be understood that the description of the seal assembly 62 in many instances will be described in relation to slot 60 of the arcuate component 52, but is similarly applicable to slot 60 of arcuate component 54.

As illustrated in FIGS. 5-7, the seal assembly 62 includes at least one shim seal 64 disposed to extend a portion of a length of a sidewall 65 of the seal segment 62B, oriented substantially parallel therewith the seal segment 62B and in contact with the radial surfaces 58 (FIGS. 6 and 7) of each of the slots 60. In an embodiment, the at least one shim seal 64 is described as being disposed in a manner to reduce, if not eliminate, a hot gas path flow through a plurality of chute gaps (described presently) at the T-junctions 63 defined by the seal slot 60 and seal segments 62A, 62B and 62C. As illustrated in FIG. 6, a plurality of shim seals 64 are disposed to seal a first chute gap 66 defined between the seal segments 62A and 62B and the slot segment 60A at the T-junction 63 and a second chute gap 68 between the seal segment 62B and the slot segment 60B. The at least one shim seal 64 should be designed such that it does not create significant resistance when the seal segment 62B is inserted into the slot segment 60B, yet sufficiently stiff to withstand a pressure differential between the high-pressure side of the seal assembly (FIG. 4—designated HP) and a low-pressure side of the seal assembly (FIG. 4—designated LP).

In some particular embodiments, each of the slot segments 60A, 60B and 60C has a thickness of approximately 0.500 millimeters to approximately 6.35 millimeters and a width of approximately 1.75 millimeters to approximately 40 millimeters. In an embodiment, each of the slot segments 60A, 60B and 60C has a thickness dimension of ~3.25 millimeters and a width dimension of 22.61 millimeters. In some particular embodiments, each of the seal segments 62A, 62B and 62C has a thickness of approximately 0.17 millimeters to approximately 3.17 millimeters and a width of approximately 3.0 millimeters to approximately 35.0 millimeters. In an embodiment, each of the seal segments 62A, 62B and 62C has a thickness dimension of 2.667 millimeters and a width dimension of ~19.56 millimeters.

Figure 8:
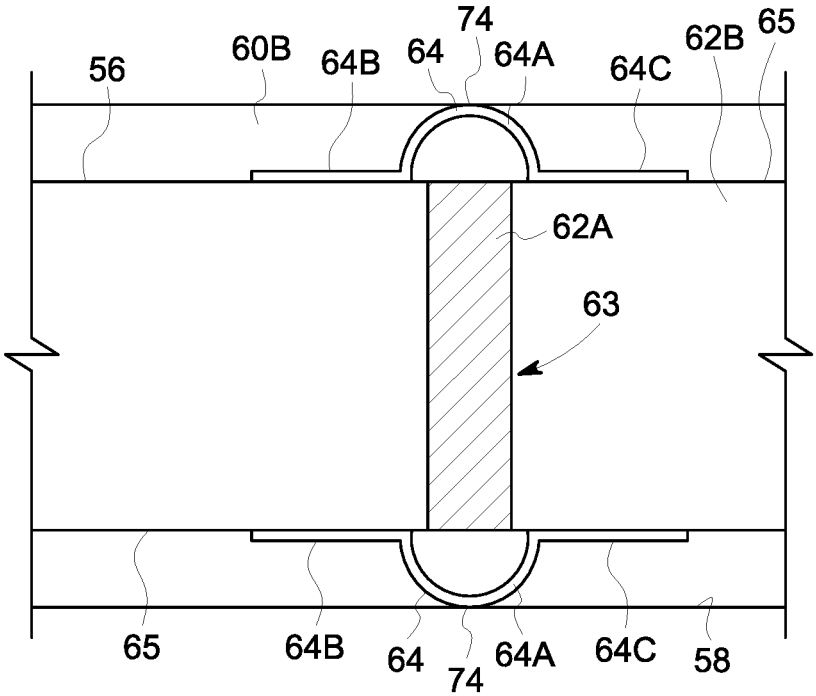
FIG. 8 shows a schematic cross-sectional view of a portion of an alternate embodiment of a seal assembly, in accordance with one or more embodiments shown or described herein.
Figure 9:
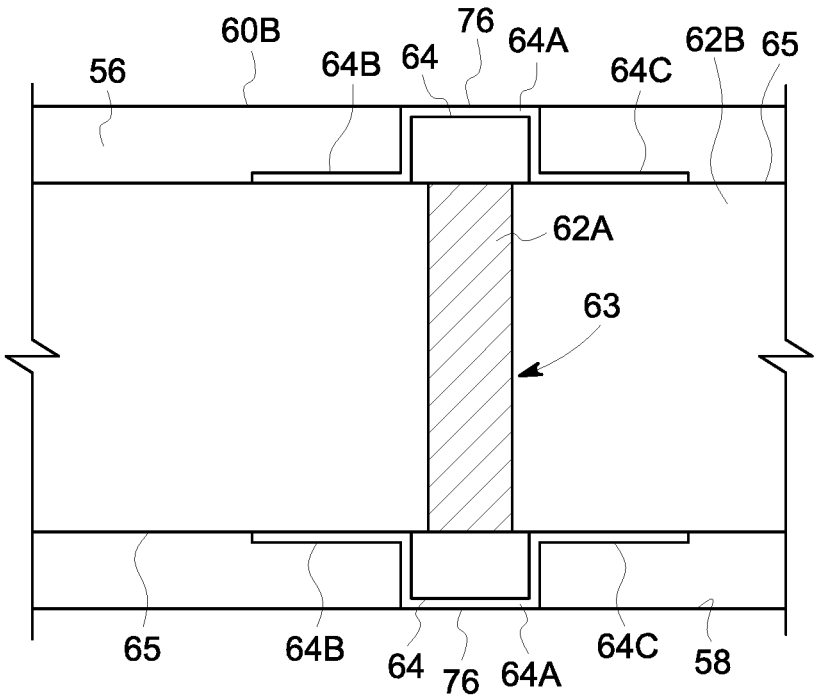
FIG. 9 shows a schematic cross-sectional view of a portion of an alternate embodiment of a seal assembly, in accordance with one or more embodiments shown or described herein.
Figure 10:
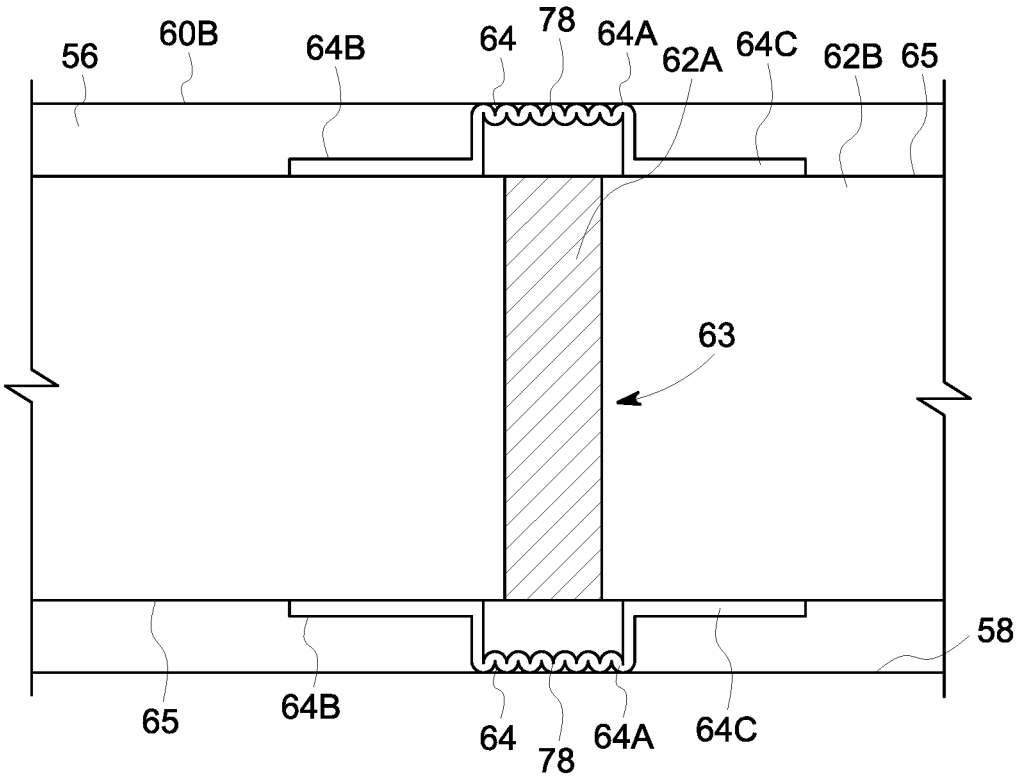
FIG. 10 shows a schematic cross-sectional view of a portion of an alternate embodiment of a seal assembly, in accordance with one or more embodiments shown or described herein.
Figure 11:
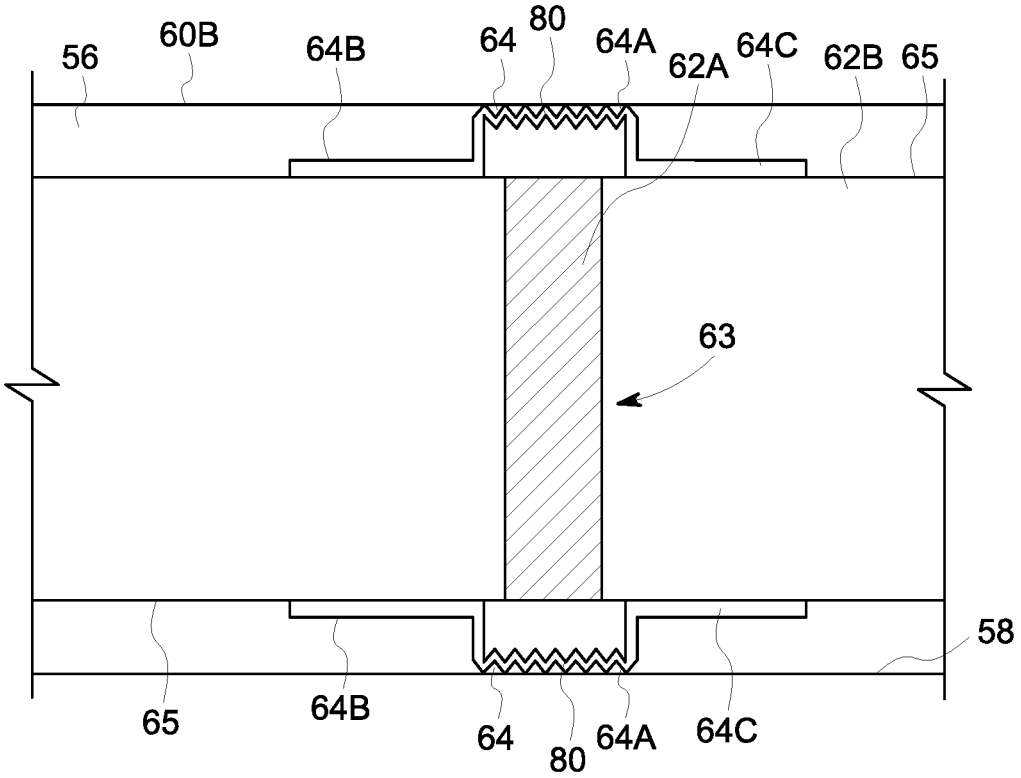
FIG. 11 shows a schematic cross-sectional view of a portion of an alternate embodiment of a seal assembly, in accordance with one or more embodiments shown or described herein.

As shown in FIG. 7, each of the plurality of shim seals 64 includes a plurality of shim seal segments defining a geometric bump-out 64A disposed between and coupled to a plurality of axial extending leg portions 64B and 64C. In an embodiment, the geometric bump-out 64A and the plurality of axial extending leg portions 64B and 64C are integrally formed. In this particular embodiment, each geometric bump-out 64A is configured as a three-sided bump-out 72, having a general shape of one-half of a six-sided polygon. In alternate embodiments, as illustrated in FIGS. 8-11, the geometric bump-out 64A may be configured having any shape capable of sealing the chute gaps 66 and 68. More particularly, the geometric bump-out 64A may have a curved or semi-circular shape 74, as illustrated in FIG. 8. Alternatively, the geometric bump-out 64 may include multiple generally planar sidewalls 76, as illustrated in FIG. 9, or multiple generally planar sidewalls coupled to each other by a waveform sidewall 78, as illustrated in FIG. 9, or multiple generally planar sidewalls coupled to each other by a serrated, or accordion-like sidewall 80, as illustrated in FIG. 10. In each embodiment, the geometric bump-out 64 is configured to deform when disposed within the slot 60B relative to the seal segment 62B to seal chute gaps 66 and 68. As previously indicated, in the drawings, like numbering represents like elements between the drawings.

It should be understood that the three segment shim seal of FIGS. 5-11 is merely for illustrative purposes, and any number of segments may form each of the at least one shim seals 64. According to an embodiment, each of the at least one shim seals 64 are adapted to deform when the seal assembly 62 is positioned within the slot 60B to form a seal between the seal segment 62B and the slot segment 60B.

Referring again to FIGS. 5-7, in an embodiment, the at least one shim seal 64, and more particularly at least one of the plurality of axial extending leg portions 64B and 64C of each shim seal 64 is coupled to a radial sidewall 65 of the seal segment 62B. In an embodiment, only one of the plurality of axial extending leg portions 64B or 64C of each shim seal 64 is coupled to the seal segment 62B to allow for the leg portion that is not coupled to the seal segment 63B to slideably move relative to the radial sidewall 65 of the seal segment 62B during deformation of the shim seal 64. In another embodiment, both of the plurality of axial extending leg portions 64B and 64C of each shim seal 64 are coupled to the seal segment 62B to fixedly position the axial extending leg portions 64B and 64C to the radial sidewall 65. In yet another embodiment, the shim seal 64 is disposed in the slot 60B relative to the seal segment 62B and maintained in position by friction fit. In an embodiment including a plurality of shim seals 64, each is configured to deform independently of one another.

In an embodiment, the at least one shim seal 64 substantially seal the chute gaps 66 and 68 and resultant chute leakage defined at the T-junctions 63, and more particularly defined between neighboring seal segments 62A and 62B and the slot 60, and between neighboring seal segment 62B and 62C and the slot 60.

The arrangement as disclosed provides a compact, relatively simple seal assembly design that can be at least partially pre-assembled to aid in engine assembly (e.g., numerous seal pieces of the seal assembly 62 may be held together with shrink-wrap, epoxy, wax, or a similar binding material that burns away during engine operation). In alternate embodiments, the seal is assembled in the engine piece-by-piece (i.e. utilizing no binding materials) and may not include any pre-assembly.

Figure 12:
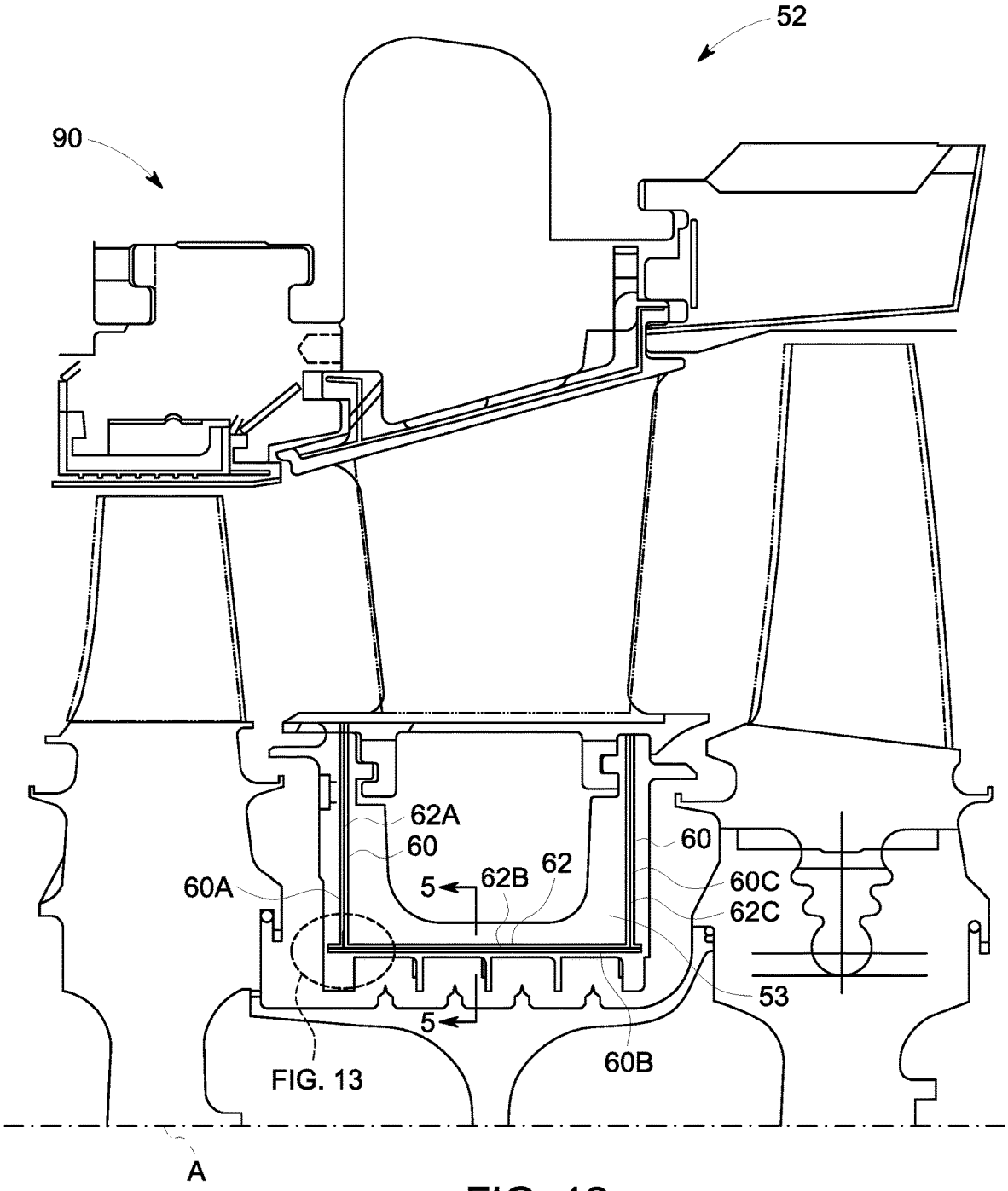
FIG. 12 shows a schematic cross-sectional view of a portion of another embodiment of a turbine, in accordance with one or more embodiments shown or described herein.
Figure 13:
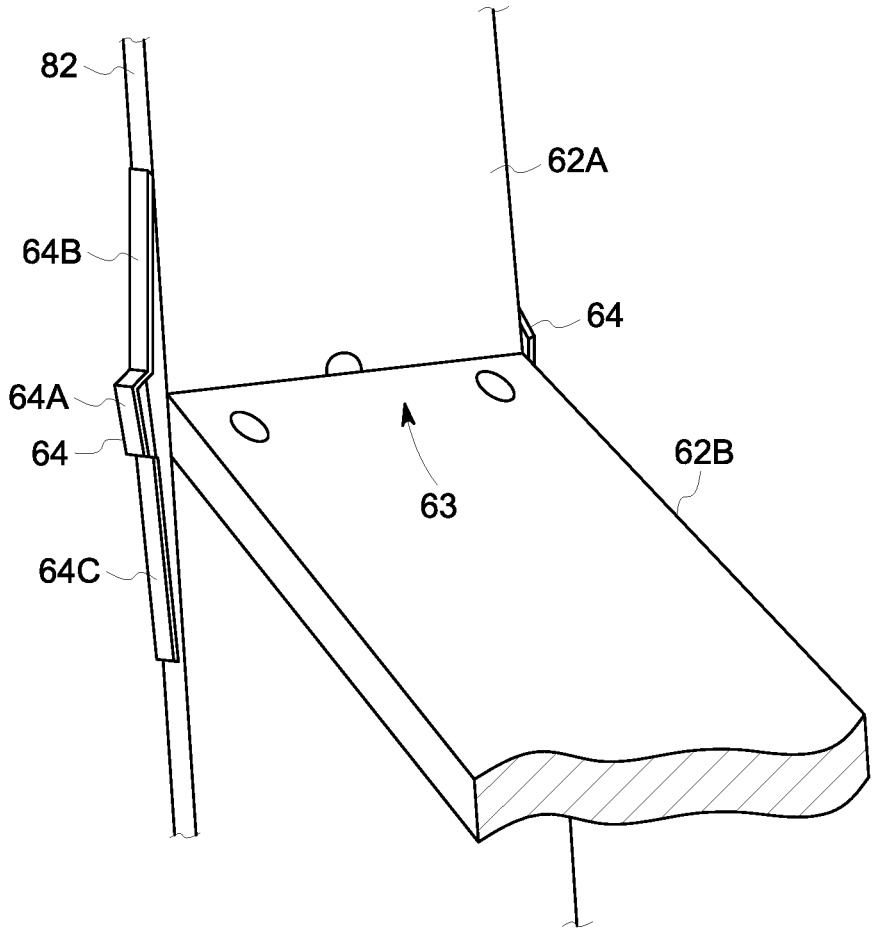
FIG. 13 shows a partial isometric cross-sectional view of the seal assembly of FIG. 12, in accordance with one or more embodiments shown or described herein.
Figure 14:
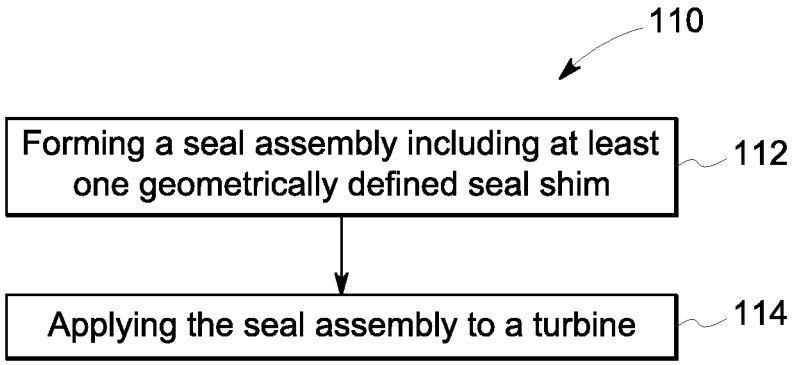
FIG. 14 shows a flow diagram illustrating a method, in accordance with one or more embodiments shown or described herein.

FIGS. 12 and 13 show a portion of a gas turbine 90 according to an additional embodiment. More particularly, FIG. 12 shows an enlargement of an alternative embodiment of a seal assembly 62 as disclosed herein. FIG. 13 is an enlargement of a portion of the seal assembly 62, as indicated by dashed circle in FIG. 12. It is understood that commonly labeled components between the various Figures can represent substantially identical components (e.g., one or more slots 60 comprised of multiple slot segments 60A, 60B and 60C, plurality of seal segments 62A, 62B, 62C, axial surfaces 56 and radially facing surfaces 58 extending from opposite ends of the axial surfaces 56, etc.). In an embodiment, the turbine 90 includes the seal assembly 62 disposed in the slot 60, where the seal assembly 62 contacts the slot surfaces in a manner to minimize, if not eliminate, chute leakage as previously described.

Similar to the previous embodiment, the seal assembly 62 includes a shim seal 64 disposed in the slot 60, wherein the slot 60 is comprised of slot segments 60A, 60B and 60C. The seal assembly 62 is disposed within the slot segments 60A, 60B and 60C and includes a plurality of seal segments 62A, 62B, and 62C. In contrast to the embodiment disclosed in FIGS. 4-7, in the illustrated embodiment of FIGS. 12 and 13, the slot segments 60A and 60C extend a distance beyond seal segment 60B. When disposed therein the slot segments 60A, 60B and 60C, the seal segment 62B intersects the seal segments 62A and 62C to form a plurality of T-junctions 63. More particularly, each seal segment 62A and 62C extends a distance on either side of the intersection of seal segment 62B with the seal segments 62A and 62C. As previously described, the T-junctions 63 may form chute gaps that allow for chute leakage flow, as previously described.

A plurality of shim seals 64, configured as any of those previously described in FIGS. 7-11, are disposed in the slot segments 60A and 60B, relative to the seal segments 62A and 62C, respectively, in a manner to span the seal segment sidewalls 92 (FIG. 13) at the T-junctions 63, to reduce, if not eliminate chute gap leakage. In contrast to the embodiment of FIGS. 4-7, in this particular embodiment, the plurality of leg portions 64B and 64C of the seal shim 62 extend radially to span the T-junctions 63. As previously described, the shim seals 64 may be coupled to a respective seal segment 62A and 62C, or disposed having a friction fit between the slot segments 60A and seal segment 62A and between the slot segment 60C and seal segment 62C.

FIG. 10 is a flow diagram illustrating a method 100 of forming a seal in a gas turbine according to various Figures. The method can include the following processes:

Process P1, indicated at 112, includes forming a seal assembly (e.g., seal assembly 62), the forming including providing a plurality of seal segments 62A, 62B and 62C and at least one shim seal 64 (e.g., segments 64A, 64B and 64C). Process P2, indicated at 114, includes applying the seal assembly 62 (e.g., the plurality of seal segments 62A, 62B and 62C and the at least one shim seal 64) to a turbine (e.g., gas turbine 50, 90, FIGS. 4 and 12), where applying includes inserting the seal assembly 62 in a slot 60 such that the at least one shim seal 64 is positioned relative to sidewalls 65, 92 of the seal segments 62B or 62A and 62C and the slot 60 to minimize, if not eliminate chute gap leakage flow. Each of the at least one shim seals 64 is configured to deform and may slideably move relative to a respective seal segment and slot wall to provide chute gap sealing.

It is understood that in the flow diagram shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments. In addition, it is understood that the shim seal 64, and more particularly, the bump-out portion 64A may include any geometry capable of providing chute gap sealing when disposed in a respective slot. In addition, it is understood that each of the at least one shim seals 64 need not be of similar geometry.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A seal assembly to seal a gas turbine hot gas path flow in a gas turbine, the seal assembly comprising:

a segmented seal comprising at least a first seal segment and a second seal segment, the second seal segment having a first face, a second face, and a sidewall extending therebetween, the first seal segment intersecting and extending transverse to the first face of the second seal segment such that at least one T-junction is formed at the intersection, and such that the first seal segment and the second seal segment at least partially define at least one chute gap; and at least one shim seal comprising a plurality of shim seal segments, the at least one shim seal positioned within a slot including a plurality of slot segments defined proximate the at least one T-junction, such that the at least one shim seal contacts at least a length of the sidewall of the second seal segment to seal the at least one chute gap to reduce or eliminate a flow of the gas turbine hot gas path flow therethrough.

2. The seal assembly of claim 1, wherein the at least one shim seal comprises a geometric bump-out extending between and coupled to a plurality of leg portions of the at least one shim seal, the plurality of leg portions extending a first distance away from the sidewall, the geometric bump-out extending a second distance away from the sidewall, wherein the second distance is greater than the first distance.

3. The seal assembly of claim 2, wherein the geometric bump-out is adapted to deform.

4. The seal assembly of claim 2, wherein the geometric bump-out comprises at least one of: a plurality of planar sidewalls, a waveform sidewall, a serrated sidewall, or a curved sidewall.

5. The seal assembly of claim 2, wherein at least one of the plurality of leg portions is fixedly secured to the sidewall of the second seal segment.

6. The seal assembly of claim 2, wherein at least one of the plurality of leg portions is slideably movable along the sidewall.

7. The seal assembly of claim 2, wherein the plurality of leg portions are friction fit between the sidewall and a sidewall defining the slot.

8. The seal assembly of claim 1, wherein the at least one shim seal is moveable independently of at least one other shim seal.

9. The seal assembly of claim 1, wherein the first seal segment is moveable independently of the second seal segment.

10. The seal assembly of claim 1, wherein the first seal segment and the second seal segment are one of:

a spline seal, a solid seal, a laminate seal, or a shaped seal.

11. The seal assembly of claim 1, wherein the chute gap is defined between the first seal segment, the second seal segment, and the slot when the first seal segment and the second seal segment are within the slot, and wherein the at least one shim seal is positioned within the chute gap defined between the first seal segment, the second seal segment, and the slot when the first seal segment and the second seal segment are within the slot.

12. A gas turbine comprising:

a first arcuate component adjacent to a second arcuate component, each arcuate component including a slot defined in an end face, each slot including one or more slot segments, each slot segment including one or more axial surfaces and one or more radial surfaces extending from the one or more axial surfaces, the one or more slot segments defining one or more T-junctions; and a seal assembly positioned in the slot of the first arcuate component and the slot of the second arcuate component, the seal assembly comprising: a segmented seal comprising at least a first seal segment and a second seal segment, the second seal segment having a first face, a second face, and a sidewall extending therebetween, the first seal segment intersecting and extending away from the first face of the second seal segment such that at least one T-junction is formed at the intersection, and such that the first seal segment and the second seal segment at least partially define at least one chute gap; and at least one shim seal positioned in at least one of the slot of the first arcuate component and the slot of the second arcuate component proximate the at least one T-junction, the at least one shim seal contacting a length of the sidewall of the second seal segment, such that the at least one shim seal seals the at least one chute gap to facilitate preventing a flow of a gas turbine hot gas path flow therethrough.

13. The gas turbine of claim 12, wherein the at least one shim seal includes a geometric bump-out extending between, and integrally formed with, a plurality of leg portions.

14. The gas turbine of claim 13, wherein the geometric bump-out is deformable.

15. The gas turbine of claim 13, wherein the geometric bump-out comprises at least one of a plurality of planar sidewalls, a waveform sidewall, a serrated sidewall, or a curved sidewall.

16. The gas turbine of claim 13, wherein at least one of the plurality of leg portions is coupled to the sidewall of the second seal segment.

17. The gas turbine of claim 13, wherein at least one of the plurality of leg portions is slideably moveable move along the sidewall of the second seal segment.

18. The gas turbine of claim 13, wherein the plurality of leg portions are friction fit between a slot sidewall and the sidewall of the second seal segment.

19. The gas turbine of claim 13, wherein each of the first seal segment and the second seal segment is one of: a spline seal, a solid seal, a laminate seal, or a shaped seal.

20. A method of assembling a seal in a turbine, the method comprising:

forming a seal assembly, the forming including:

providing a segmented seal including at least a first seal segment and a second seal segment, wherein the second seal segment includes a first face, a second face, and a sidewall extending therebetween, the first seal segment extending away from the first face of the second seal segment such that at least one T-junction is formed at the intersection, and wherein the first seal segment and the second seal segment at least partially define at least one chute gap;

providing at least one shim seal including a plurality of shim seal segments oriented proximate the at least one T-junction, such that the at least one shim seal contacts a length of the sidewall of the second seal segment; and applying the seal assembly to the turbine, such that the seal assembly is inserted into a slot defined in at least a first arcuate turbine component that is adjacent to a second arcuate turbine component, and wherein the:

at least one shim seal seals the at least one chute gap to prevent a flow of a gas turbine hot gas path flow therethrough.

21. The method of claim 20, wherein the at least one shim seal comprises a geometric bump-out extending between a plurality of leg portions.

22. The method of claim 20, wherein the at least one shim seal is adapted to one of: deform via compression, or slideably moving relative to the sidewall of the second seal segment.

* * * * *